United States Patent [19]

Faré

[11] Patent Number: 5,042,376

[45] Date of Patent: Aug. 27, 1991

[54] AERODYNAMIC DAMPER FOR AN IMPACT PRINTING ACTUATOR

[75] Inventor: Carlo Faré, Limito, Italy

[73] Assignee: Bull HN Information Systems Italia S.p.A., Caluso, Italy

[21] Appl. No.: 230,624

[22] Filed: Aug. 10, 1988

[30] Foreign Application Priority Data

Sep. 2, 1987 [IT] Italy ..... 21782 A/87

[51] Int. Cl.[5] ..... B41J 9/42

[52] U.S. Cl. ..... 101/93.02; 400/157.2

[58] Field of Search ..... 400/157.2, 167, 686; 101/93.02, 93.48; 335/255

[56] References Cited

U.S. PATENT DOCUMENTS

| | | | |
|---|---|---|---|
| 3,504,623 | 4/1970 | Staller | 101/93.02 X |
| 3,941,052 | 3/1976 | Dalziel | 101/93.02 X |
| 4,308,794 | 1/1982 | Adamoli et al. | 400/157.2 |
| 4,388,861 | 6/1983 | Bohg et al. | 101/93.02 |
| 4,529,326 | 7/1985 | Mattsson | 101/93.02 X |
| 4,900,169 | 2/1990 | Falconieri et al. | 400/157.2 |

FOREIGN PATENT DOCUMENTS

| | | | |
|---|---|---|---|
| 9883 | 1/1980 | Japan | 101/93.02 |
| 193867 | 8/1986 | Japan | 400/167 |
| 30056 | 2/1987 | Japan | 101/93.02 |
| 99170 | 5/1987 | Japan | 400/167 |
| 124960 | 6/1987 | Japan | 400/167 |

*Primary Examiner*—Aaron J. Lewis

*Attorney, Agent, or Firm*—Faith F. Driscoll; John S. Solakian

[57] ABSTRACT

Aerodynamic damper for impact printing actuator in which a movable armature of a magnetic circuit has to resume, after actuation, with minimum rebounding and oscillations, a stable rest position defined by the contact of a flat surface of the armature with a flat surface of a stop element, consisting in a recess formed of at least one of the two flat surfaces and having peripheral side walls slanted as to the flat surface.

3 Claims, 1 Drawing Sheet

AERODYNAMIC DAMPER FOR AN IMPACT PRINTING ACTUATOR

BACKGROUND OF THE INVENTION

Figure 1:
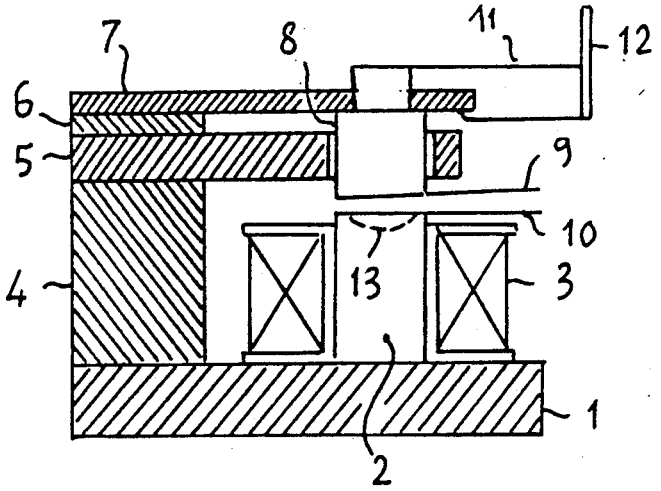

The present invention relates to an aerodynamic damper for an impact printing actuator.

The printing actuators used in high speed printers for data processing systems and particularly in dot matrix printers, consist of electromagnets where the actuation of a movable armature causes the printing operation.

Two kinds of actuators and two operative modes can be distinguished; that is, actuators provided with a simple electromagnetic and actuators provided with a permanent magnet, as well as actuators operating by armature attraction and actuators operating by armature release.

In actuators of the simple electromagnet type, operating in attraction mode, the movable armature, in rest position, is spaced apart from a magnetic pole and rests on a stop element.

An air gap is present between the armature and the magnetic pole.

The electromagnet energization causes the armature to be attracted against the magnetic pole and the deenergization causes the release and the return of the armature, imposed by resilient means, to the rest position.

In actuators of the simple electromagnet type, operating in release mode, the movable armature is, in rest condition, attracted against a magnetic pole, owing to the electromagnet energization.

The deenergization of the electromagnet causes the release of the armature, owing to resilient means and the consequent print operation, while the energization cuases the armature attraction in the rest position.

In the permanent magnet type actuators, which generally operate in release mode only, the movable armature, when at rest, is attracted against a magnetic pole.

The electromagnet energization causes the neutralization of the magnetic field produced by the permanent magnet and the consequent release of the armature. The deenergization of the electromagnet causes the armature to be pulled against the magnetic pole.

In all mentioned cases, it is required, to obtain high speed performance, that the armature returns to the rest position as fast as possible and without rebound.

To this purpose, dampers of various types have been used, such as resilient, ballistic, and pneumatic dampers.

Among dampers which more properly relate to the present invention, the device disclosed in U.S. Pat. No. 4,202,638 is to be mentioned.

In such patent, a stop element is provided which defines a flat surface against which a corresponding flat surface of the armature lays down.

During the armature return phase at rest position, a compressed air cushion is formed between the two surfaces. This cushion performs a braking action on the moving armature, and dampens its impact against the rest surface, reducing the rebound.

For the efficiency of the device, a relatively broad flat contacting surface is required, which is difficult to reconcile with the miniaturized structures of printing actuators currently used.

This limitation is overcome by the aerodynamic damper of the present invention which achieves a much greater efficiency by exploiting the aerodynamic pressure developed by the air flow between surfaces slighly converging and consists of a recess provided in the armature or in the rest element (or both) and having slanted walls as to the contact plane.

Figure 2:
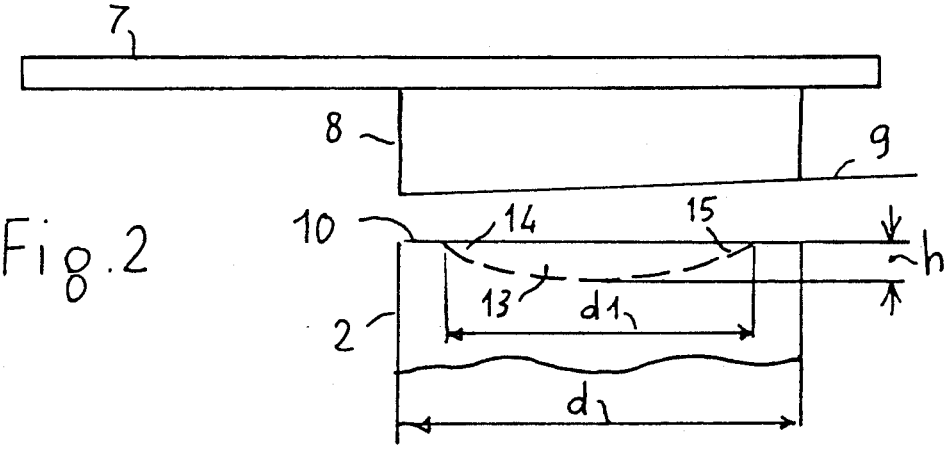
Figure 3:
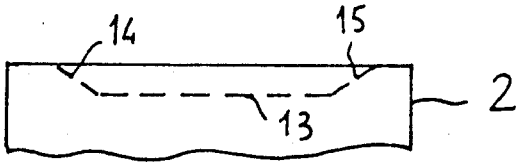
Figure 4:
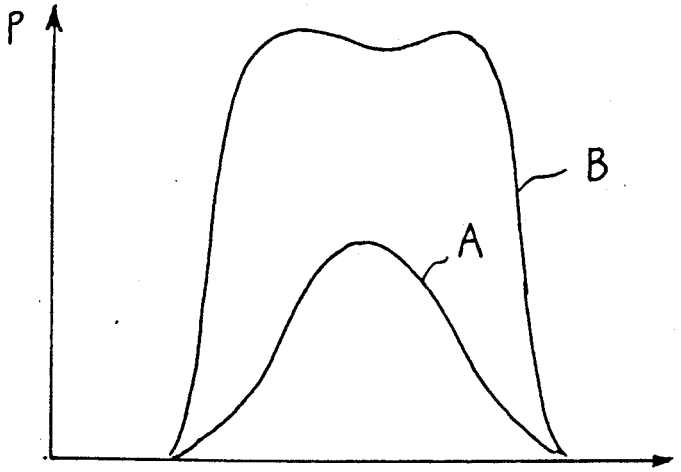

The features and the advantages of the invention will appear more clearly from the following description and the related drawings where:

FIG. 1 shows in section a preferred form of printing actuator embedding the aerodynamic damper of the invention FIG. 2 shows in section the shape of the aerodynamic damper of the invention FIG. 3 shows in section an alternative shape of the aerodynamic damper of the invention FIG. 4 shows in qualitative form the local pressure distribution caused by the aerodynamic damper of the invention compared with the one caused by a conventional damping device.

FIG. 1 shows in section a preferred form of embodiment of printing actuator embodying the aerodynamic damper of the invention.

The actuator comprises a first magnetic yoke 1, a cylindrical magnetic column 2, onto which a winding 3 is inserted, a magnetic column 4 consisting of a permanent magnet, a second magnetic yoke 5, directing the magnetic flux to column 2, a magnetic spacer 6, and a resilient magnetic armature 7 cantilever mounted on spacer 6 and extending towards magnetic column 2.

Armature 7 is provided with a cylindrical post 8 for reclosure of the magnetic circuit, the post facing the pole end of magnetic column 2 and being coaxial thereto.

Post 8 inserts in an opening of yoke 5 and faces with a flat surface 9 the upper face 10 of pole 2.

When the magnetic field of permanent magnet 4 is neutralized by a current flowing in winding 3, the resilient armature is unbent and in a released position and flat surface 9 of post 8 is spaced apart from upper face 10 of column 2 by an air gap having a width on the order of 0.5 mm.

Missing the demagnetizing current, the armature 7 is elastically bent and attracted towards column 2 and surface 9 is in contact with the upper face 10 of column 2.

Column 2 and post 8 have a diameter in the order of 4–5 mm.

Armature 7 supports, at its free end, an actuation arm 11 to which a printing needle 12 is fixed.

The above structure is entirely similar to the one shown and described by way of example in European patent application published with N 228589 but differs from it for the reason that the top of column 2 has a recess 13 as better shown in FIG. 2.

Such recess has for instance the shape of a spherical segment having a depth (height) on the order of 30–60 micron and diameter on the order of 3–4 mm.

In other words, the flat surface stopping the armature in rest position, and formed by the upper surface 10 of pole 2 has a recess 13, drawn in the pole and having peripheral walls 14, 15 slanted relative to the flat surface 10.

Alternatively, the recess 13, as shown in FIG. 3, may have a frusto-conical shape having a depth (height) on the order of 30–60 microns and maximum diameter on the order of 3–4 mm.

This very simple expedient produces a damping effect, somehow unexpected, much greater than the one provided by the compressed air cushion which is formed between two flat surfaces of equal size when they approach each other.

Without entering into a complex analytical description of the phoenomena, it may be observed, with reference to FIG. 4, that in the case of two circular flat surfaces approaching each other, a pressure distribution results which is shown in qualitative form by diagram A.

The pressure at the border is obviously equal to the ambient pressure and has a peak at the surface center.

In case one of the two surfaces or both have a slight recess as the described one, the pressure distribution is subjected to a radical change and takes the form qualitatively shown in diagram B.

In other words, the compressed air flow from which the center of the recess tends to flow to the outside exerts a dynamic push on the side walls, which is converted into a pressure increase.

Not only is the pressure peak at the center increased, but also and more important, it is broadened in width, giving rise to a much greater damping action.

It is clear that the preceding description is related to a preferred form of embodiment of the invention, but the invention may be used in printing actuators of different kinds, for instance, the actuator of the simple electromagnet type operating both in release as well as in attraction mode.

Even the positioning of the recess on the upper surface of a magnetic column is preferred for manufacturing reasons, but from a functional stand point the recess may be located as well in the movable armature, as well as in the stop element, or both.

In addition, the suggested sizing is largely susceptible of change depending on the size of the armature and stop surface, it being clear that in the case the recess affects a section of the magnetic circuit, it is advisable that the depth of the recess be limited to the order of few hundredths of a millimeter so as not to cause substantive non-uniformity in the distribution of the magnetic flux.

What is claimed is:

1. Aerodynamic damper for an impact printing actuator in which a movable armature of a magnetic circuit after actuation has to resume a stable rest position defined by the contact of a flat surface of said armature with a flat surface of a stop element, said damper including: at least one of said flat surfaces; and, only a single recess formed in said one flat surface, said recess extending along a major portion of said one flat surface and having surrounding side walls which are not perpendicular to said flat surface and completely enclose said recess, said single recess being shaped for providing a predetermined pressure distribution characterized by substantial high pressure contained within an area volume defined by said side walls and said major portion of said one flat surface of said recess for producing aerodynamic damping action on said armature during resumption to said stable rest position.

2. Aerodynamic damper, as in claim 1, wherein said recess has the form of a sperical segment with a ratio between diameter and height within 20 and 100.

3. Aerodynamic damper, as in claim 1, wherein said recess has the form of a frustum of cone with a ratio between maximum diameter and height within 20 and 100.

* * * * *